United States Patent [19]

Cormier et al.

[11] 4,423,949

[45] Jan. 3, 1984

[54] JAM DETECTION APPARATUS AND METHOD IN A PHOTOCOPIER

[75] Inventors: Raymond G. Cormier, Nashua; Richard A. Bridges, Manchester; Jeffrey L. Peterson, Nashua, all of N.H.

[73] Assignee: Nashua Corporation, Nashua, N.H.

[21] Appl. No.: 406,215

[22] Filed: Aug. 9, 1982

[51] Int. Cl.[3] ..... G03G 15/00

[52] U.S. Cl. ..... 355/14 R; 355/14 TR; 355/77

[58] Field of Search ..... 355/14 R, 14 SH, 3 SH, 355/3 TR, 77, 14 TR; 271/309, 311, DIG. 2

[56] References Cited

U.S. PATENT DOCUMENTS

| | | | |
|---|---|---|---|
| 3,360,652 | 12/1967 | Bernous | 355/14 R |
| 3,982,832 | 9/1976 | Bendall et al. | 355/14 R |
| 4,239,372 | 12/1980 | Iwai | 355/14 R |

*Primary Examiner*—R. L. Moses

*Attorney, Agent, or Firm*—Lahive & Cockfield

[57] ABSTRACT

A jam detector circuit for use in a photocopier employs feedback and visual indication circuitry for providing a stable and easily adjusted detector. Feedback is provided to desensitize the circuit to sensing device operating parameters which vary according to and within manufacturing specifications. The visual indication circuitry allows a predetermined range of signal change to be defined thereby enabling easy "set-up" of the circuit without the need of electrical metering apparatus.

9 Claims, 2 Drawing Figures

JAM DETECTION APPARATUS AND METHOD IN A PHOTOCOPIER

The invention relates generally to photocopiers and in particular to a jam detection method and apparatus for use in photocopiers.

BACKGROUND OF THE INVENTION

In a typical photocopier, a sheet material is fed toward a moving photosensitive surface at a transfer station of the apparatus. A developed latent electrostatic image on the photosensitive surface is transferred onto the sheet material at the transfer station and the sheet material is thereafter directed along an exit path for delivery to the exit tray. The step of directing the sheet material away from the transfer station typically requires the use of a pick-off mechanism to detach and remove the sheet material from the photosensitive surface.

Due to the fragile nature of the photosensitive surface, many different pick-off mechanisms have been developed and employed. These pick-off mechanisms vary in accordance with the particular photocopier, including for example whether the photocopier is of the dry developer type or the liquid developer type. In either instance, however, there occurs from time to time a "missed pick-off". In these circumstances, the sheet material, instead of being directed along an exit path, continues to adhere to the moving photosensitive surface and travels downstream in the direction of a cleaning station for the photocopier.

In many commercial copiers, the problem of the sheet material contaminating or otherwise damaging either the cleaning station or the photosensitive surface is substantially avoided by employing what are commonly called secondary pick-offs. These pick-offs provide a second chance for removing the sheet material from the moving photosensitive surface. Other apparatus such as that described in U.S. Pat. No. 4,320,961, entitled "Jam Detecting Method and Apparatus for Electrostatic Copier" (assigned to the assignee herein) employ a sensor juxtaposed to the moving photosensitive surface for causing the moving photosensitive surface to stop at an appropriate position before damage to the photosensitive surface or the cleaning station can occur. According to that patent, the photosensitive surface, which forms part of a liquid photocopying system, stops at a time when the sheet material forms a small loop between the cleaning station and the transfer station. This enables easier removal of the sheet material from the apparatus.

Thus, according to U.S. Pat. No. 4,320,961, and other photocopying systems wherein apparatus is provided to prevent the sheet material from marring the photosensitive surface or otherwise damaging the operating stations through which the photosensitive surface passes, a sensor is used to sense the presence of the sheet material on the photosensitive surface. The circuitry to which the sensor is connected is thus required to discriminate the various signals coming from the sensor and to reliably indicate the presence of sheet material. However, the presence of noise, either electrical noise or noise in the form of foreign matter or other particles on the photosensitive surface, poses substantial impediments to reliable operation of the circuitry. The "jam detector circuit," which is often very sensitive, must be precisely tuned, for example to accommodate the manufacturing tolerances of sensing element. However, even so, the circuitry is often very complex and substantially intolerant of the manufacturing tolerances found in mass produced devices.

Principle objects of the invention are therefore a jam detection apparatus and method which are reliable, low cost, simple to build and operate, and which provide significant tolerance to standard, off-the-shelf components employed in the circuit. Thereby, another object of the invention is a jam detection apparatus and method which are relatively insensitive to the circuit components being employed and to the environment in which the circuit is operated.

SUMMARY OF THE INVENTION

The invention relates to an apparatus and method for use in a photocopier. The photocopier has a moving photosensitive surface and a sheet stripping station (generally a part of the transfer station) for removing a copy sheet material from contact with the photosensitive surface and for directing it along an exit path. The apparatus of the invention relates to detecting a missed sheet pick-off at a position downstream, relative to the direction of movement of the photosensitive surface, of the sheet stripping station. The apparatus features a sensor for detecting a sheet material on the moving photosensitive surface, the sensor effecting a change in a sensor electrical parameter in response to the presence of the sheet material. The sensor is mounted in opposed juxtaposition to the moving photosensitive surface at a position downstream of the sheet stripping station. A first circuit responds to the parameter change for generating a first electrical signal therefrom; and a second circuit responds to the electrical signal for conditioning the photocopier into a jam state. A feedback circuit desensitizes the signal responsive circuit and the parameter responsive circuit so that sensors having significantly different operating parameters, due to standard manufacturing tolerances, can be employed. The feedback circuit obviates the need for readjusting the responsive circuits which might otherwise have been necessary even if the parameter operating variations had not been significant. This enables standard components to be purchased without requiring the use of special selection practices.

The apparatus further features a signal responsive circuit having a comparator circuit for establishing a first comparison output signal when the electrical signal is in a first signal range and a second comparison output signal when the electrical signal is outside of the signal range. A range defining circuit is connected to the comparator circuit for aiding in establishing the signal range and a signal generation circuit and an indicating circuit are employed in connection with an operational amplifier for providing calibration signals in the apparatus.

Preferably, the feedback circuit operates to control an actuating power which is applied to the sensor and thereby varies the effective gain of the sensor, and hence its response to the sheet material.

The method of the invention relates to the steps of sensing the sheet material at a position downstream of the sheet stripping station and providing an electrical signal output in response to the presence of the sheet material. The method features the steps of responding to the electrical signal output for conditioning the copier to a jam condition and desensitizing the circuitry providing the electrical signal output, preferably using feedback, so that the circuitry is not overly responsive to the parameter operating variations of off-the-shelf sensor elements.

BRIEF DESCRIPTION OF THE DRAWINGS

Other objects, features and advantages of the invention will appear from the following description of a preferred embodiment, taken together with the drawings, in which.

DESCRIPTION OF A PREFERRED EMBODIMENT

Figure 1:
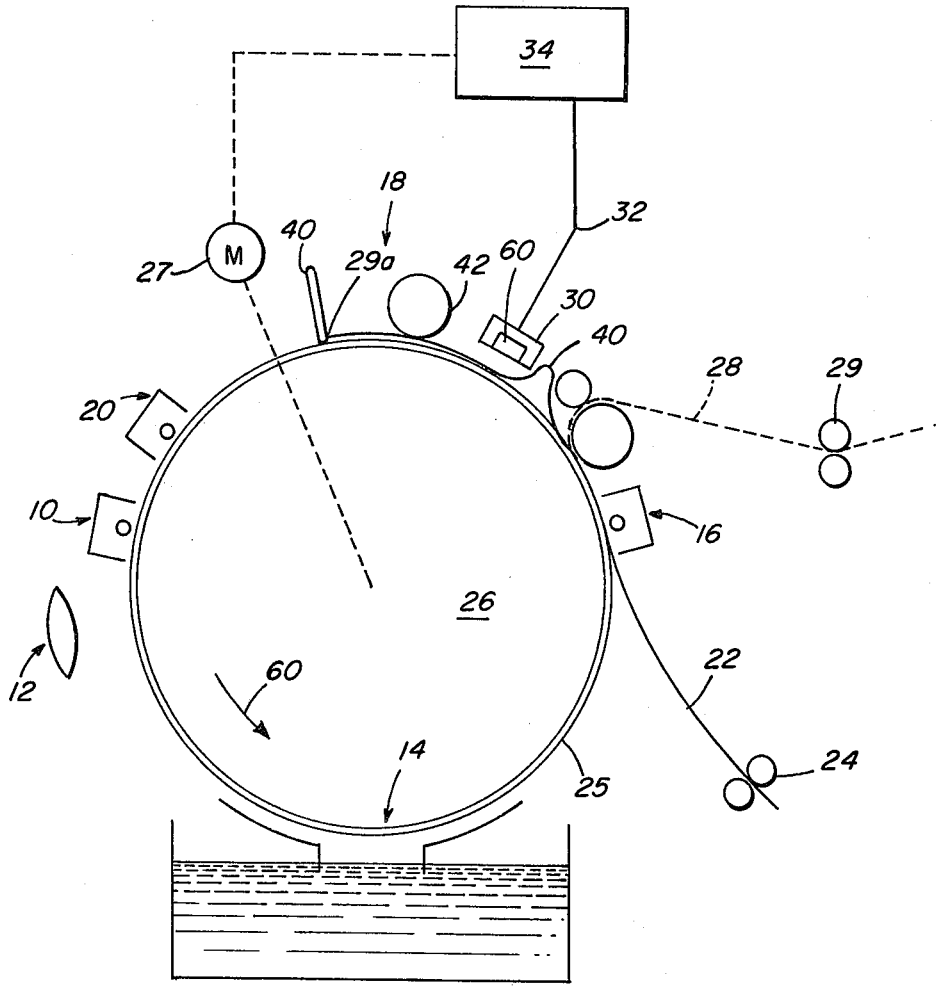
FIG. 1 is a schematic representation of a typical liquid photocopying apparatus in which the present invention can be employed.

Referring to FIG. 1, a liquid developer photocopier typically has a charging station 10, an exposure station 12, a development station 14, a transfer station 16, a cleaning station 18, and a charge neutralizing station 20. A sheet of copy material 22, for example plain bond paper, is typically fed from a sheet feeding assembly 24 toward the transfer station 16. At the transfer station, the sheet is applied to a moving photo-sensitive surface 25, for example in the form of a selenium layer on the conductive outer surface of a rotating drum 26 driven by a motor 27, and on which surface 25 there is a film of liquid toner defining a developed image. The charged toner particles are electrostatically attracted to the sheet at the transfer station and the toned image is thereby transferred to the sheet. A "pick-off" apparatus (not shown) removes the sheet from the photosensitive surface 25 and directs it along an exit path 28 shown in phantom toward a sheet discharge assembly 29, whereby the copy sheet is delivered to the copier exit pocket. If the copy sheet is not removed from the photosensitive surface 25, according to the invention, it is detected as a copy sheet leading edge **29*a* passes beneath a sheet detection assembly 30 positioned between the transfer station and the cleaning station. The sheet detection assembly 30 has a sensor 60 for providing a signal indicating the presence or absence of sheet material on the photosensitive surface. In response to this signal, a jam detection circuitry 34 terminates rotation of the drum 26 by stopping the drive motor 27**, and renders the electrostatic copier inoperative for making further copies until the missed sheet is removed and the copier is reset.

The cleaning station 18 typically includes a cleaning blade 40 and a cleaning roller 42. The cleaning blade contacts the photosensitive surface 25 across its width, in a direction normal to its surface, and applies a pressure against the surface.

Figure 2:
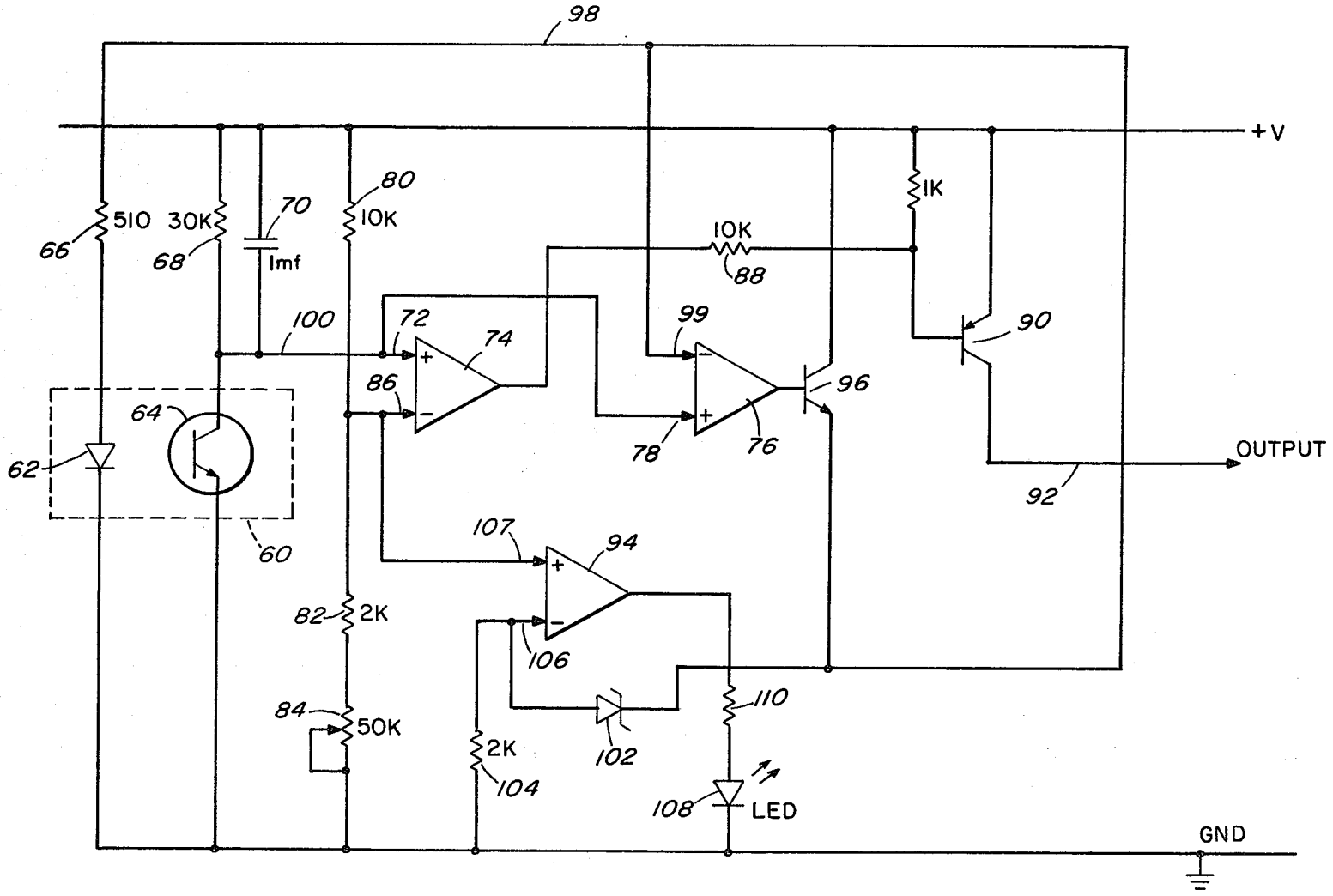
FIG. 2 is an electrical circuit diagram of a preferred embodiment of the jam detector circuit according to the invention.

Referring to FIG. 2, the illustrated sensor 60, for example a General Instrument, type MCA7, has a light emission portion, a light emitting diode (LED) 62, and a photoreceiver portion, a photodiode 64. Power to the LED 62 is provided by a feedback circuit through a resistor 66. As shall be described below in more detail, the emission from the diode 62 is controlled in accordance with the feedback circuit parameters.

The light energy emitted by diode 62 is directed at and reflected by the juxtaposed moving surface. The reflected light energy impinges upon illustrated photoreceiver 64 and causes its electrical resistance to vary. That resistance, in combination with a low pass filter including a resistor 68 and a capacitor 70 provides a voltage signal at an input 72 of an operational amplifier 74. The voltage signal at input 72 is also applied to a second operational amplifier 76 at its input 78.

The other input to operational amplifier 74, which is configured to operate as a comparator, is provided by the voltage divider network formed by fixed resistors 80 and 82 and a variable resistor 84. As shall be described below, this voltage divider network can be adjusted to provide and define a comparison voltage range from which, in the illustrated embodiment, the voltage at input 72 of operational amplifier 74 must pass before the presence of a sheet material is "declared". The output of the voltage divider network is applied to a negative input 86 of operational amplifier 74. The output of operational amplifier 74 is connected through a resistor 88 to a power transistor 90 connected to provide a collector output over a line 92 to drive for example a relay circuit. The change in output over line 92 provides for a circuit actuation to, for example, place the photocopier in or condition the photocopier to the jam state. In the jam state, a controlled shutdown of the photocopier is effected.

Operational amplifier 76, in combination with an operational amplifier 94 and a transistor 96 provide a feedback arrangement for desensitizing the circuitry to normal manufacturing tolerance variations in sensor 60. Operational amplifier 76 and transistor 96 operate to provide, over a feedback line 98, a signal level which depends upon the output of the sensor 60 when no sheet material is present. The other input 99 to operational amplifier 76 is the feedback voltage over line 98 and the output of the operational amplifier 76 is applied to the base of transistor 96. The voltage level on line 98 is thus forced to be substantially equal to the voltage level input to amplifier 76 at input 78. This has the effect of providing a higher operating voltage to the LED 62 for a sensor having a lower gain and a lower operating voltage for a sensor having a higher gain so that, substantially, the voltage input at inputs 72 and 78, when no sheet material is present is within a tolerable, controlled range of operation.

The voltage on line 98, which is substantially equal to the voltage at the sensor output, line 100, is "dropped" in the illustrated embodiment by approximately 2.7 volts, through a zener diode 102. The zener diode 102 is connected through a resistor 104 to ground. The voltage therefore, at input 106 of amplifier 94, is approximately 2.7 volts less than the voltage on line 100. Amplifier 94 has its other input 107 connected to the input 86 of amplifier 74. The output of operational amplifier 94 is connected to ground through a light emitting diode 108 and a resistor 110. By adjusting the voltage at input 86 of operational amplifier 74, using potentiometer 84, the desired voltage range for reliable operation of the detection system is set. In this illustrated embodiment, the voltage at input 86 is set about 2.7 volts less than the voltage at input 72 when no sheet material is present. The proper setting can be achieved, by examining visually, the operation of the light emitting diode 108, which is powered through the resistor 110 by operational amplifier 94. In the illustrated embodiment, an approximately fifty percent duty cycle (that is, LED 108 being on about one-half the time) indicates that the signal level at input 86 of amplifier 74 is approximately 2.7 volts less than the voltage at input 72 of amplifier 74. This provides therefore a very convenient and advantageous method and circuit apparatus for setting the operating point of the circuit without the need for sophisticated or expensive metering equipment. Furthermore, if a new sensor is required, a screwdriver adjust of the potentiometer 84 can be easily made to provide a substantially identical operating point for the circuit.

After the operating set point of the circuit has been fixed, noise, for example electrical noise spikes or particles of dust or dirt on the photosensitive surface, will be ignored due to the operation of the low pass filter (formed by resistor 68 and capacitor 70) operating in combination with the required decrease of about 2.7 volts at input 72 before detection of sheet material is determined.

ADVANTAGES AND NON-OBVIOUSNESS OF THE INVENTION

The invention advantageously provides a new method and apparatus for desensitizing a jam detector circuit so that off-the-shelf components, and in particular the sensor, can be employed without prior selection. This reduces the costs inherent in a special selection process and further makes the circuitry more reliable and stable.

The invention further advantageously features a novel circuit for visually setting the voltage range, or threshold, which in turn defines when a jam is "declared". The ability to visually set this circuit without special metering equipment, in the field, greatly simplifies the setting of the circuit and provides a serivce repairman with a reliable and uncomplicated method for readjusting the circuit after components of the circuit have been changed.

While earlier circuitry used a sensor directed at the photosensitive surface of the photocopier for detecting sheet material, none of those circuits employed either the advantageous feedback circuit or the visual adjustment circuit which had been described herein. These circuits provide significant advantage and are not employed in any earlier reference of which we are aware.

Additions, subtractions, deletions, and other modifications of the disclosed illustrated embodiment of the invention are within the skill of those practiced in the art and are within the following claims.

What is claimed is:

1. In a photocopier comprising a moving photosensitive surface, and a sheet stripping station for removing a copy sheet material from contact with the photosensitive surface, apparatus for detecting a missed sheet pick-off comprising a sheet material sensor responsive to the presence of the sheet material on the photosensitive surface for effecting a change in a sensor electrical parameter in response to the presence of said sheet material, means for mounting said sensor in opposed juxtaposition to said photosensitive surface at a position downstream of the sheet stripping station, means responsive to said parameter change for generating a first electrical signal therefrom, means responsive to said first electrical signal for conditioning said photocopier to a jam state, and feedback circuit means for desensitizing said signal responsive means and said parameter responsive means to parameter operating variations of said sensor.

2. The apparatus of claim 1 wherein said signal responsive means further comprises a comparator circuit for establishing a first comparison output signal when the first electrical signal is in a first signal range and a second comparison signal when said first electrical signal is outside of said signal range, and a range defining circuit connected to said comparator circuit for aiding in establishing said signal range.

3. The apparatus of claim 2 wherein said comparator circuit comprises an operational amplifier having a first and a second input, said first input being connected to said parameter responsive means, and said range defining circuit includes a range defining signal generation circuit connected to said amplifier second input, and an indicator circuit connected to said amplifier second input for providing an indication of the signal range defined by said generation circuit.

4. The apparatus of claim 3 wherein said range defining signal generation circuit comprises a voltage divider circuit connected to said second amplifier input for setting said signal range.

5. The apparatus of claim 4 wherein said indicator circuit comprises a zener diode for controlling a voltage difference for aiding in determining said signal range.

6. The apparatus of claim 1 wherein said feedback circuit comprises means for controlling an actuating power applied to the sensor for varying the response of said sensor, said controlling means being responsive to said sensor output.

7. The apparatus of claim 1 further comprising a low pass filter circuit connected to said first electric signal output for discriminating against false short time duration signal values from said sensor.

8. An apparatus for detecting a missed sheet pick-off in a photocopier, the photocopier having a moving photosensitive surface and a sheet stripping station for removing a copy sheet material from contact with the photosensitive surface, the apparatus comprising a sheet material sensor responsive to the presence of a sheet material remaining on the photosensitive surface for effecting a change in sensor output as a result of the presence of the sheet material, means for mounting the sensor in juxtaposition to the photosensitive surface at a position downstream of the sheet stripping station, means responsive to the change in sensor output for generating a first electrical signal therefrom, said means including a low pass filter circuit connected to the first electrical signal for discriminating against false short time duration signal values as a result of sensor changes not due to the presence of a sheet material, a comparator circuit for establishing a first comparison output signal when the first electrical signal is in a signal range indicating the absence of a sheet material and a second comparison signal when the first electrical signal is outside of said signal range indicating the presence of a sheet material, said comparator circuit having an operational amplifier having a first input and a second input, the first input being connected to the parameter responsive means, a range defining circuit connected to the comparator circuit for aiding in establishing said signal range, said range defining circuit including a range defining signal generation circuit connected to said operational amplifier second input, and an indicator circuit connected to the amplifier second input for providing an indication of the signal range defined by said generation circuit, and a feedback circuit for compensating the sensor output signal and the output of the parameter responsive means for operating variations of the sensor, said feedback circuit comprising means for controlling an actuating power applied to the sensor for varying the gain of the sensor, and said controlling means being responsive to the sensor output.

9. In a photocopier having a moving photosensitive surface and a sheet stripping station for removing a copy sheet material from contact with the photosensitive surface, a method for detecting a missed sheet pick-off at a position past the sheet stripping station comprising the steps of sensing the presence of the sheet material on the photosensitive surface at said position and providing a first electrical output signal in response thereto, conditioning the photocopier to a jam state in response to said electrical signal when a sheet material is sensed on the drum, and automatically compensing for variations in said sheet sensing mechanism using a signal feedback to accommodate sensing mechanisms within a range of manufacturing tolerance.

* * * * *